United States Patent [19]

Ray

[11] Patent Number: 4,553,638

[45] Date of Patent: Nov. 19, 1985

[54] HOSE TENSIONING DEVICE

[75] Inventor: William C. Ray, Cedar Lake, Ind.

[73] Assignee: Allis-Chalmers Corporation, Milwaukee, Wis.

[21] Appl. No.: 630,746

[22] Filed: Jul. 13, 1984

[51] Int. Cl.[4] ..... B66B 9/20

[52] U.S. Cl. ..... 187/9 E; 285/161; 285/302

[58] Field of Search ..... 187/9 E, 1 A, 9 R; 285/302, 114, 115, 161, 190; 267/60

[56] References Cited

U.S. PATENT DOCUMENTS

| | | | |
|---|---|---|---|
| 1,171,311 | 2/1916 | Blackwood et al. | 285/302 |
| 3,296,361 | 1/1967 | Markland et al. | 285/302 X |
| 4,123,092 | 10/1978 | Colbert, Jr. | 285/302 X |
| 4,244,449 | 1/1981 | Renk et al. | 187/9 E |
| 4,361,175 | 11/1982 | Mongrolle | 285/190 X |

FOREIGN PATENT DOCUMENTS

| | | | |
|---|---|---|---|
| 220553 | 7/1958 | Australia | 187/9 E |

*Primary Examiner*—Joseph J. Rolla
*Assistant Examiner*—Nils E. Pedersen
*Attorney, Agent, or Firm*—Charles L. Schwab

[57] ABSTRACT

A hose tensioning device is provided to suitably tension a flexible hydraulic hose used on a lift truck so as to reduce damage that might otherwise occur should the hose become slack. The hose tensioning device serves as a hydraulic connector and its outer component is a protective housing for the biasing spring by which the hose is tensioned.

8 Claims, 2 Drawing Figures

HOSE TENSIONING DEVICE

BACKGROUND OF THE INVENTION

1. Technical Field

This invention relates to a tensioning device for a hydraulic hose on a lift truck and more particularly to a hose tensioning device which also serves as a hydraulic connector.

2. Prior Art

U.S. Pat. No. 4,244,449, issued Jan. 13, 1981 to Friedrich Renk and Jurgen Handel for a "Tensioning Device for Tensioning of Hydraulic Hoses on Telescopic Lift Mast Assemblies" shows two versions of a hose tensioning device in which a hose pulley is shiftably mounted on a lift truck and biased by a coil spring.

SUMMARY OF THE INVENTION

A tensioning device for a flexible hose includes a pair of relatively reciprocatable fluid conveying elements, one of which is adapted for rigid mounting on a support. The one element includes wall means defining a passage therethrough having cylindrical surfaces defining coaxial cylindrical bores adjacent opposite ends of the passage. The wall means also defines a port at one side of the one element in fluid communication with an intermediate part of the passage and adapted for connection to a fluid conduit. The other of the elements has cylindrical portions complementary to and reciprocatably engaging the cylindrical surfaces of the one element and includes an end portion extending in one axial direction beyond the one element. The other element includes wall means defining an axial port in the end portion, a radial opening in an intermediate part of the other element which is disposed within the one element and an interior passageway extending between the port and the radial opening. The end portion is adapted for connection to a flexible hose extending in the one axial direction in generally aligned relation to the bores. Resilient biasing means are interposed between the elements so as to urge the other element in an axial direction opposite to the one axial direction whereby the hose connected to the other element is tensioned.

The resilient biasing means may take the form of a coil compression spring surrounding the other element and disposed within the passage in the one element intermediate its bores.

An important object of this invention is the provision of a hose tensioning device having a pair of relatively reciprocating elements which also serve as a fluid connector.

BRIEF DESCRIPTION OF THE DRAWINGS

One embodiment of the invention is illustrated in the drawings in which.

DETAILED DESCRIPTION OF THE DRAWINGS

Figure 1:
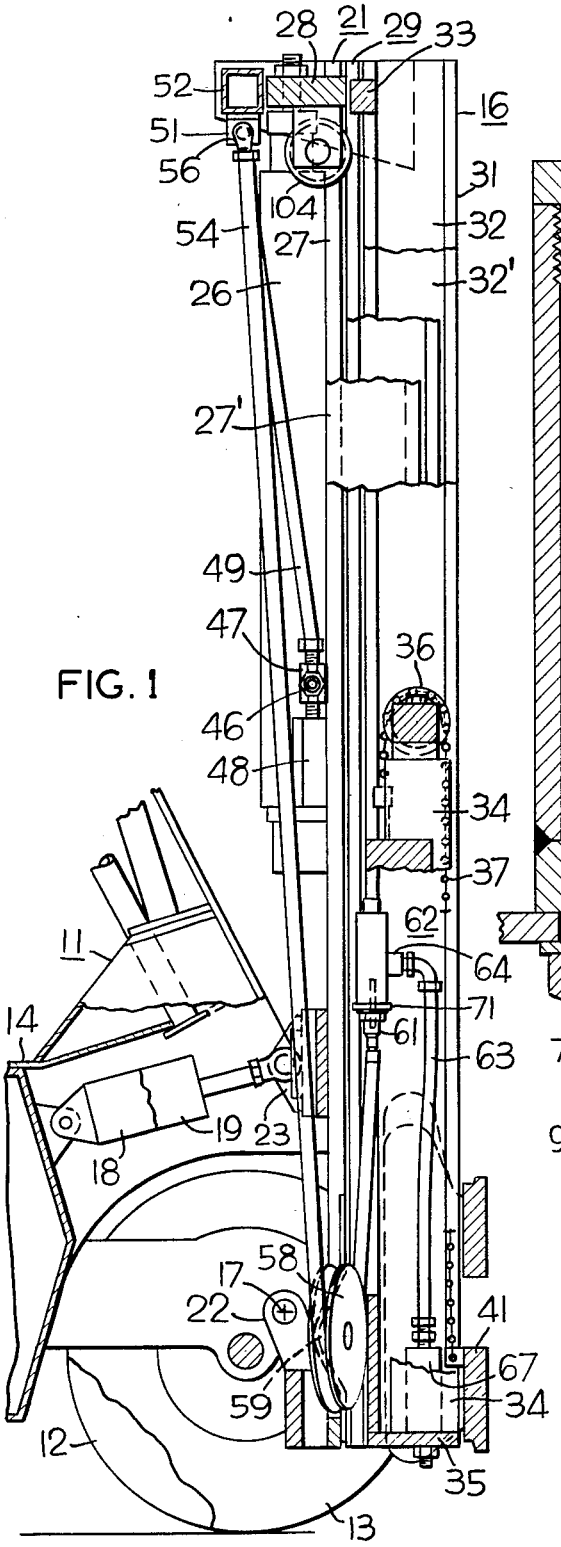
FIG. 1 is a partial side view of the front part of a lift truck with parts broken away for illustration purposes.

Referring to the drawings, a lift truck 11 includes a pair of front drive wheels 12, 13 supporting the front end of the lift truck frame 14 on which a three-section mast 16 is pivotally connected for swinging movement about a transverse pivot axis 17. A pair of tilt cylinders

18, 19 are provided to tilt the mast 16 about the transverse pivot axis 17. A primary mast section 21 includes a pair of brackets 22, only one of which is shown, by which the mast 16 is pivotally connected to the truck and also includes a pair of brackets 23, only one of which is shown, by which the tilt cylinders 18, 19 are connected to the mast 16. The outer mast section 21 includes a pair of lift cylinders 26, only one of which is shown, which are disposed behind the laterally spaced uprights 27, 27'. The upper ends of the lift cylinders 26 are connected to a cross member 28 of an intermediate mast section 29. An inner mast section 31 includes a pair of uprights 32, 32', which are interconnected at their tops by a cross brace 33 and at their bottoms by a plate 35. A carriage lift cylinder 34 is mounted on the plate 35 and its rod end carries a pair of pulleys 36, only one of which is shown, over which a pair of chains 37, only one of which is shown, are reeved which have corresponding opposite ends connected to the inner mast section 31 and to a lift carriage 41, respectively. The lift truck 11 includes a source of pressure fluid, not shown, which is connected by suitable distribution means, not shown, to an inlet 46 of a tee connector 47. The bottom end of the tee connector is connected to a hydraulic inlet block 48 on the bottom of the cylinder 26 and the upper end of the tee is connected to a hydraulic conduit or hose 49 whose upper end is connected to a bracket 51 secured to a cross member 52 on the upper end of the outer mast section 21. Fluid in hose 49 passes to a downwardly extending hose 54 by way of suitable hydraulic connecting means 56 which secures the upper end of the hose 54 to the bracket 51. The hose 54 is reeved about a pulley 58 pivotally mounted on a laterally extending bracket 59 secured to the intermediate mast section 29. The hose 49 extends upwardly having its other end connected to a reciprocatable piston-like element 61 of a hose tensioning device 62. A fluid conduit 63 connects a port 64 on the side of the stationary outer element 66 of the hose tensioning device 62 to a hydraulic connector block 67 on the bottom of the carriage cylinder 34.

Figure 2:
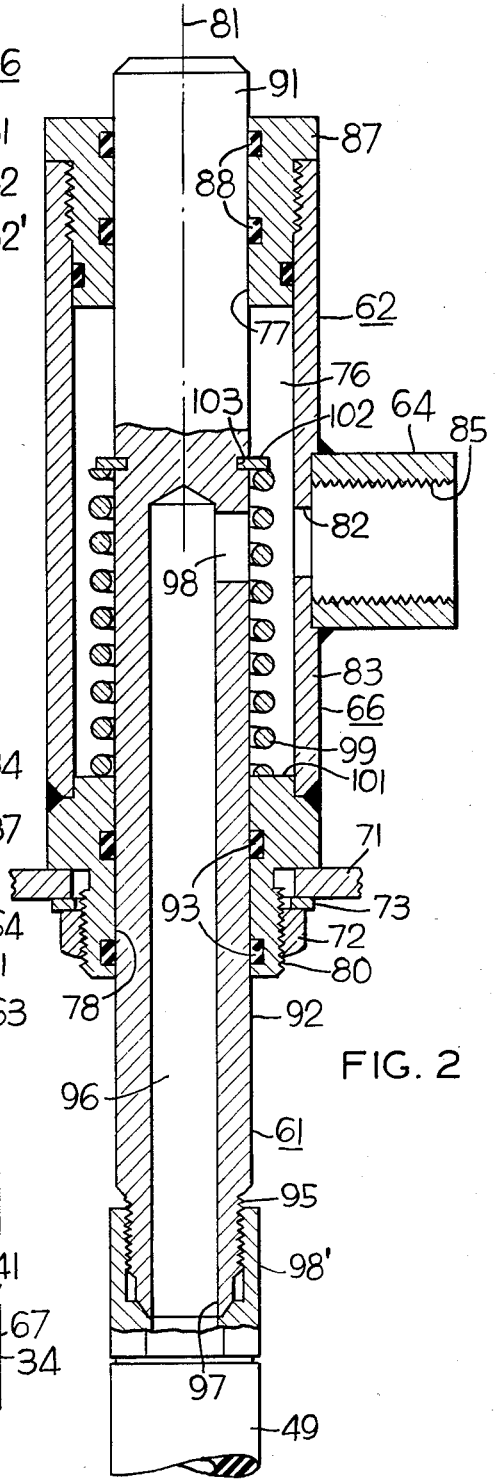
FIG. 2 is an enlarged vertical section of the hose tensioning device used in the lift truck shown in FIG. 1.

Referring to FIG. 2, the hose tensioning device 62 has its outer element 66 secured to a bracket 71 by a nut 72 and a washer 73. The bracket 71 is rigidly secured, as by welding, to the inner mast section 31 and the nut 72 is threaded onto an externally threaded, reduced diameter portion 80 at the lower axial end of the outer element 66. The outer element 66 includes an interior cavity or passage 76 which includes wall means defining radially inwardly facing cylindrical surfaces 77, 78 including bores at the opposite ends of the passage 76 aligned on a axis 81. A port, formed in part by an internally threaded nipple 64 secured by welding to the cylindrical tube part 83 of the outer element 66, includes a radial opening 82 in the tube part 83 aligned with the interior threaded passage 85 of the nipple 64. The tube part 83 of the outer element 66 is internally threaded at its upper end to receive an exterior threaded gland 87 which carries suitable radial seals 88 sealingly engaging an upper cylindrical portion 91 of the reciprocating piston-like element 61. The inner element 61 has a lower cylindrical portion 92 whose exterior surface is complementary to the bore 78 and is in reciprocating or sliding engagement therewith. A pair of radially acting annular seals 93 are provided to seal the cylindrical portion 92 relative to the cylindrical surface 78 in the lower end of the stationary outer element 66.

The inner element 61 includes an interior passageway 96 which extends from an axial opening or port 97 at the lower end portion 95 of the element 61 to a radially opening port 98 which interconnects the passageway 96 with the interior chamber 76 and, hence, with the radial port 85. The lower end portion 95 of the inner element 61 is threaded to receive a hose connector 98' by which one end of the hose 49 is secured to the reciprocatable element 61. A compression spring 99 surrounds the element 61 and is interposed between a shoulder 101 in the cavity 76 and a snap ring 102 in a groove 103 of the inner element 61.

OPERATION

The hose tensioning device 62 serves to maintain the hose 49 under tension during operation of the lift truck including extension and contraction of the three-section mast 16. During extension of the three component lift cylinders 26, a chain and pulley connection between the outer mast section 21 and the inner mast section 31 causes the inner mast section to move upwardly at twice the speed of the intermediate mast section. One of the pulleys 104 is shown in FIG. 1. By maintaining the hose 49 under tension, there is a reduced chance of it being pinched by adjacent mast components during operation of the mast and it is less likely to come off the pulley 58. During installation of the hose 49 and the hose tensioning device 62, the hose length is selected to compress the coil spring 99 to approximately the condition illustrated, which is an intermediate condition of compression. In the fully retracted condition of element 61, wherein the snap ring 102 abuts the end of gland 87, the spring is slightly compressed from its nonassembled length to provide a predetermined resilient resistance to downward movement of element 61. The tensioning device is dimensioned to provide proper tensioning of the hose 49 over a predetermined change in the length of the hose 49. The hose 49, within predetermined limits of elongation, is a resilient member. The tension exerted and change in length of the hose can be determined experimentally by use of commercially available test equipment. The relatively movable elements 61, 66 of the tensioning device also serve as a hydraulic coupling or connector for the hose 49 and the conduit 63, thus saving the cost of a connector and its mounting as would otherwise be required. The spring 99 is disposed in concentric surrounding relation to the inner element 61 and is disposed within the cavity 76 of the outer element 66. Thus, the spring is bathed in hydraulic fluid which minimizes wear of the spring and parts it abuts. The spring is also protected against accidental damage and lodging of foreign material between its coils.

The embodiments of the invention in which an exclusive property or privilege is claimed are defined as follows:

1. A hose tensioning device for a flexible hose comprising:

a pair of relatively reciprocatable fluid conveying elements, one of said elements being adapted for rigid mounting on a support and including wall means defining a passage therethrough including cylindrical surfaces defining coaxial cylindrical bores adjacent opposite ends of said passage and a port at one side of said one element in fluid communication with an intermediate part of said passage and adapted for connection to a fluid conduit, the other of said elements including cylindrical portions complementary to and slidingly engaging said cylindrical surfaces and having an end portion extending in one axial direction beyond said one element, said other element including wall means defining an axial port in said end portion, a radial opening in an intermediate part of said other element, said intermediate part disposed within said one element and an interior passageway extending between and interconnecting said axial port and said radial opening, said end portion being adapted for connection to a flexible hose extending in said one axial direction in generally aligned relation to said bores, and resilient biasing means interposed between said elements operative to urge said other element axially in an axial direction opposite to said one axial direction whereby said hose is tensioned.

2. The hose tensioning device of claim 1 wherein said resilient biasing means being a coil compression spring surrounding said other element and disposed within said passage in said one element between said bores.

3. The hose tensioning device of claim 2 wherein said end portion of said other element includes external threads adapted to receive a threaded hose connector.

4. The hose tensioning device of claim 3 wherein the end of said one element remote from said end portion of said other element includes a removable gland in which one of said bores is formed.

5. The hose tensioning device of claim 4 wherein said one element includes an externally threaded end concentric with said bores adapted to pass through a hole in said support and to receive a nut by which said one element is rigidly securable to said support.

6. In a lift truck having relatively extensible and contractible inner and outer sections with a hydraulic cylinder carried by said inner section and supplied hydraulic pressure fluid by a flexible hose, a hose tensioning device comprising:

an outer elongated element secured to one of said mast sections and having wall means defining a passage lengthwise therethrough with aligned cylindrical bores at its opposite ends and a radial port in said passage, conduit means operatively interconnecting said radial port and said hydraulic cylinder, an inner piston-like element having axially spaced cylindrical portions in sealing engagement with said bores and an end portion secured to one end of said hose, wall means in said inner element defining an axial port at an axial end of said end portion, a radial opening intermediate said cylindrical portions and a passageway placing said axial port and radial opening in fluid communication with one another, and resilient biasing means engaging said inner element urging it in an axial direction to tension said hose sufficiently to substantially remove the slack therefrom.

7. The combination of claim 6 wherein said passage between said cylindrical bores is enlarged to provide an internal cavity with which said radial port and radial opening are in fluid communication and wherein said biasing means includes a coil spring in said cavity in surrounding relation to said inner element.

8. The combination of claim 7 wherein said inner mast includes a horizontally extending bracket with a vertical opening therein, wherein external threads are formed on a reduced diameter end portion of said outer element, and wherein said reduced diameter end portion extends through said vertical opening and further comprising a threaded fastener in threaded engagement with said threaded reduced diameter end portion whereby said outer element is rigidly secured to said inner section.

* * * * *